US006101835A

United States Patent [19]

Butsch et al.

[11] Patent Number: 6,101,835

[45] Date of Patent: Aug. 15, 2000

[54] WATER AND ICE DISPENSING APPARATUS

[75] Inventors: Otto R. Butsch, Placentia; Charles J. Helton, Dana Point; Otto R. Butsch, Jr., Yorba Linda, all of Calif.

[73] Assignee: OSO Technologies, Rancho Cucamonga, Calif.

[21] Appl. No.: 09/285,625

[22] Filed: Apr. 3, 1999

Related U.S. Application Data

[60] Provisional application No. 60/080,643, Apr. 3, 1998, and provisional application No. 60/080,644, Apr. 3, 1998.

[51] Int. Cl.[7] ..... B67D 5/62

[52] U.S. Cl. ..... 62/390; 222/146.1

[58] Field of Search ..... 62/390, 389, 391, 62/394, 395; 222/146.1; 165/61

[56] References Cited

U.S. PATENT DOCUMENTS

| | | | |
|---|---|---|---|
| 3,429,140 | 2/1969 | White | 62/339 |
| 4,048,044 | 9/1977 | Eibl | 204/257 |
| 4,823,554 | 4/1989 | Trachtenberg | 62/3 |
| 4,881,380 | 11/1989 | Mrugala et al. | 62/389 |
| 5,108,563 | 4/1992 | Cook | 204/149 |
| 5,192,004 | 3/1993 | Burrows | 222/146.1 |
| 5,291,752 | 3/1994 | Alvarez | 62/344 |
| 5,405,052 | 4/1995 | Sawyer | 222/64 |
| 5,493,873 | 2/1996 | Donselman et al. | 62/390 |
| 5,577,393 | 11/1996 | Donselman et al. | 62/390 |
| 5,603,230 | 2/1997 | Tsai | 62/390 |
| 5,667,103 | 9/1997 | Donselman et al. | 62/394 |
| 5,706,883 | 1/1998 | Ward | 165/61 |

*Primary Examiner*—William E. Tapolcai
*Attorney, Agent, or Firm*—Kenneth J. Hovet

[57] ABSTRACT

A water cooler is provided having a cabinet with water spigots and a door for accessing a refrigeration unit. The refrigeration unit includes a freezer compartment and may also include an icemaker. The cabinet interior contains a water reservoir which is supplied with water from a water bottle inverted in the top of the cabinet. Alternatively, the reservoir may be provided with an external source of water. In such case, an *E-Coli* sanitization module and a particulate water filter are provided. Cooling is effected with a compressor unit, condenser unit, an expansion valve and the refrigeration unit—all of which are interconnected with a closed loop coolant line. Predetermined segments of the coolant line are used to create freezing temperatures in the freezer compartment and non-freezing temperatures in a storage area, selected water lines and the reservoir. The condenser unit includes a condenser coil section which may be wrapped with ambient water for producing a supply of hot water. The coil section may also function to preheat ambient water that is moved to a hot water tank. The cabinet may include a pull-out section for placement of a water bottle in a lower chamber. In this case, a pump or air pressure is used to move water from the bottle into the interior heating and cooling system.

13 Claims, 10 Drawing Sheets

WATER AND ICE DISPENSING APPARATUS

This application claims priority from pending provisional patent application Ser. Nos. 60/080,643 and 60/080,644, both of which were filed Apr. 3, 1998.

BACKGROUND OF THE INVENTION

1. Field of the Invention

The present invention relates to water coolers and, more particularly, to water coolers that provide hot water, cold water and icemaking capabilities.

2. Description of Related Art

Prior art bottled water coolers have long provided a convenient source of fresh purified water to offices, work sites and homes. Their usefulness is limited, however, at sites in which a refrigerator is not available. In such cases, users will not have access to cold water or ice. This disadvantage is especially felt in hot areas and at work sites where significant physical work is involved.

The bottled water station described in U.S. Pat. No. 5,019,004 seeks to overcome the above disadvantages. This patent provides a system that includes hot, cold and room temperature water outlets. A removable water bottle operates in conjunction with an interior reservoir which is divided by an orificed baffle plate. The plate separates an upper room temperature chamber from a chilled cold-water lower chamber. The water station further includes a hot water tank having a heater band wrapped around its circumference.

A major problem with the above system is that the baffle creates a highly inefficient separation between warm water and cold water. Convention currents passing through the baffle orifices will diminish the temperature gradient between the two waters. Also, the hot water heater supply pipe passes through the cold water zone. This creates significant thermal inefficiency. Additionally, the thin baffle plate provides an exceptionally poor insulative means for thermal separation between the ambient and cold chambers.

U.S. Pat. No. 5,405,052 provides an improvement over the above system wherein the water reservoir and icemaker are both contained in a freezing chamber. This system may freeze the water in the reservoir. Also, the arrangement is inefficient because the freezing chamber comprises the entire interior of the cabinet. As such, all of the cabinet must be heavily insulated. Additionally, the freezing means must have a significant capacity for maintaining the large interior at a temperature below freezing.

Still further, to inhibit the reservoir water from freezing solid, the reservoir must be heavily insulated. This redundancy is costly.

In an alternative embodiment, the patent discloses a cabinet divided into a cooling compartment and a freezer compartment. The compartments are separated by an insulated wall. However, this system requires separate thermostats and refrigerating means to maintain an above-freezing temperature in one compartment and a below freezing temperature in another. Clearly, this requires extraordinary refrigerating assemblies, unnecessary control systems and significant interior and exterior insulative wall structures.

SUMMARY OF THE INVENTION

The present invention overcomes the above prior art deficiencies through the use of modular interchangeable components. The components interact with each other in a compact cabinet to effect water heating, cooling and freezing functions. Each function is interrelated to provide the most energy-efficient result within the smallest possible space.

The dispensing cabinet itself is designed to have a clean, pleasing appearance for use in one's home, work site or at the office. It has special utility for locations that do not have a ready source of water.

The cabinet interior encloses a refrigeration region and a compressor/condenser region. The regions are thermally distinctive and separate from each other. The refrigeration region encompasses a freezer compartment and a water reservoir. The region is cooled by circulating coolant through a multi-part evaporator means, a compressor unit, condenser unit and expansion valve.

The freezer compartment may have an associated storage area which will be cold but not freezing. In this way, it will be suitable for storing food and beverages. The freezer compartment may include an icemaker and ice container. Both are accessible through a common opening in the front wall of the cabinet.

The ice container can be removed from the apparatus for cleaning. To facilitate removal while maximizing ice storage volume, collapsing means can be used to reduce the container's size. Telescoping container walls provide one option.

The ice container can also comprise a collapsible bag with walls made of an elastic or flexible water-proof material such as heavy fabric, plastic or nylon. In this way, the bag may simply be crumpled to reduce its vertical height or it may be creased in an accordion pattern.

The invention includes one or more heat exchange means to heat and dispense water. Examples of such means are coils of a water line wrapped around the hot tubing of the condenser. This example provides pre-heated water which may be stored in a heated receptacle. Means for heating the receptacle and hot water lines are electrical resistance rods, wires, meshes, strips and tapes known in the art.

For maximum efficiency, thermal insulation materials may be applied to the water lines, water receptacle and reservoir. Insulating the entire cabinet is not necessary. Examples of thermal insulation include fiberglass matting, preformed polystyrene, sprayed-on polyurethane foam and elastic polymer coatings.

Melted frost water or spilled water may be collected in a defrost tray located beneath at least the freezer compartment. An extended portion of the condenser tubing may be placed in the tray to facilitate evaporation of the accumulated water. This action will also help to cool the condenser lines.

The defrost tray may include a moisture-detecting sensor. Once the sensor detects a predetermined amount of water, the sensor will activate a fan which directs air over the tray. The moving air helps to evaporate the water and also cool the condenser.

The invention further contemplates a means for equalizing the pressure gradient between the inlet and outlet lines of the compressor. By equalizing the pressure differential, less power will be needed to start the compressor. The equalizing means comprises a capillary tube interconnecting the compressor inlet and outlet lines.

An insulated cabinet door provides access to the refrigerating unit. However, the invention includes an optional self-adjusting door having an auxiliary spring-biased panel and a resilient gasket extending about the door periphery.

Chilled water may be produced by use of a cold extension structure emanating from the refrigerator housing. The structure is sized to permit a water line to be wrapped around its circumference. This enables water flowing within the line to be chilled by thermo-conductive contact with the extension.

Another cooling means comprises the use of selected segments of the refrigerator coils. The coils are wrapped or otherwise juxtaposed adjacent structures where cooling is desired. This technique provides significant efficiencies and cost savings.

In addition to gravity flow, the invention encompasses the use of pump means and/or air pressure means to move water through the system. These alternatives are advantageous because they allow placement of a water bottle in the lower portion of the cabinet. As so disposed, the need for lifting and structurally supporting a top-mounted water bottle is eliminated.

In circumstances where water is piped-in from an external source, unique *E-Coli* water purifying means are provided in the inlet water line. Particulate filtering means and taste improving treatments such as charcoal filters and reverse osmosis membranes may also be included.

An additional option suitable for use as part of the invention is the provision of a cabinet extension for hot plates and a coffee maker. This option will significantly expand the usefulness of the apparatus.

It will be appreciated that the various subassemblies and parts described above are interchangeable. They are readily integrated with each other to create significant efficiencies in cost, size and energy requirements.

DESCRIPTION OF THE PREFERRED EMBODIMENTS

Figure 1:
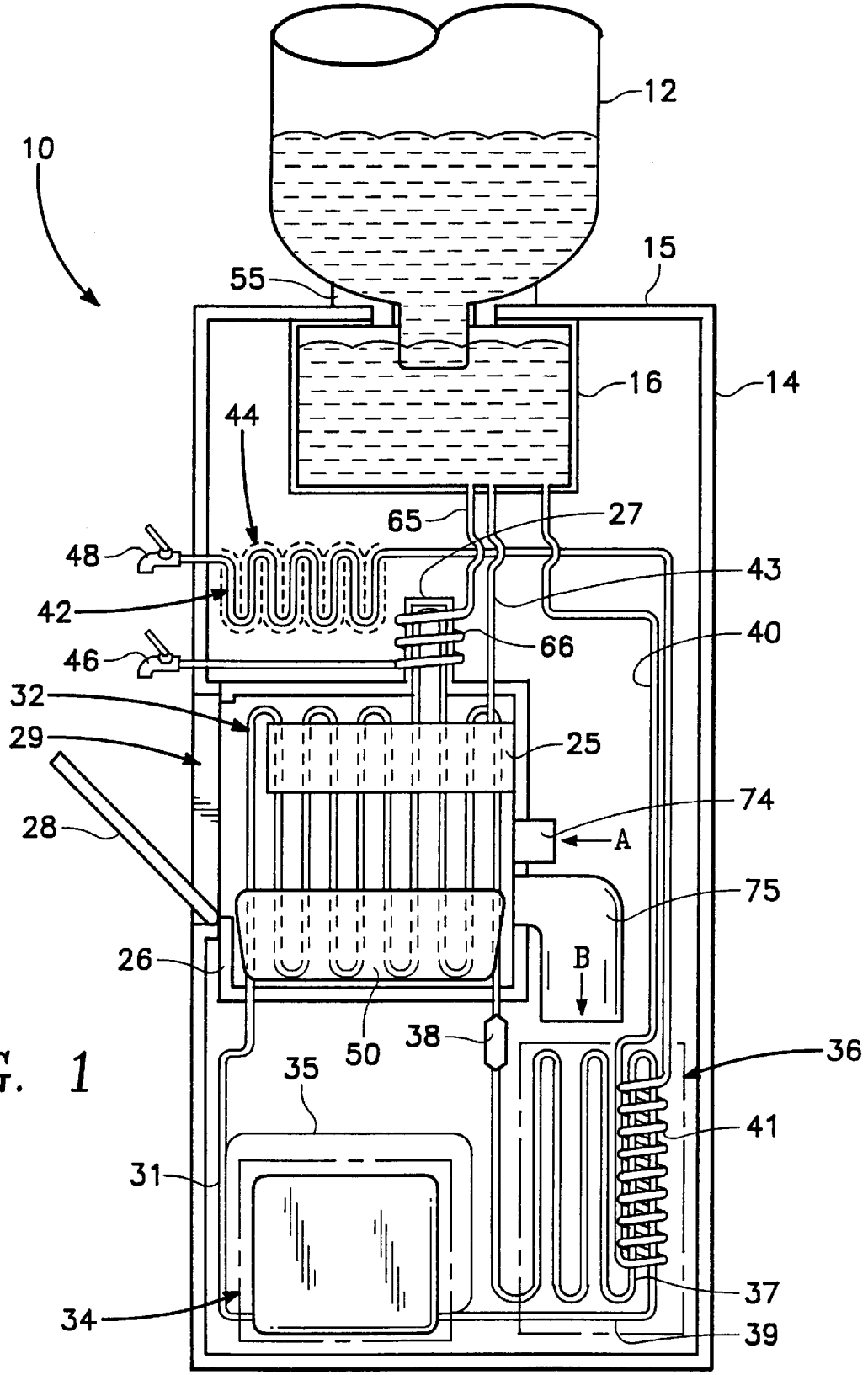
FIG. 1 is a schematic side elevational view of a first embodiment of the water and ice dispensing apparatus of the invention.
Figure 2:
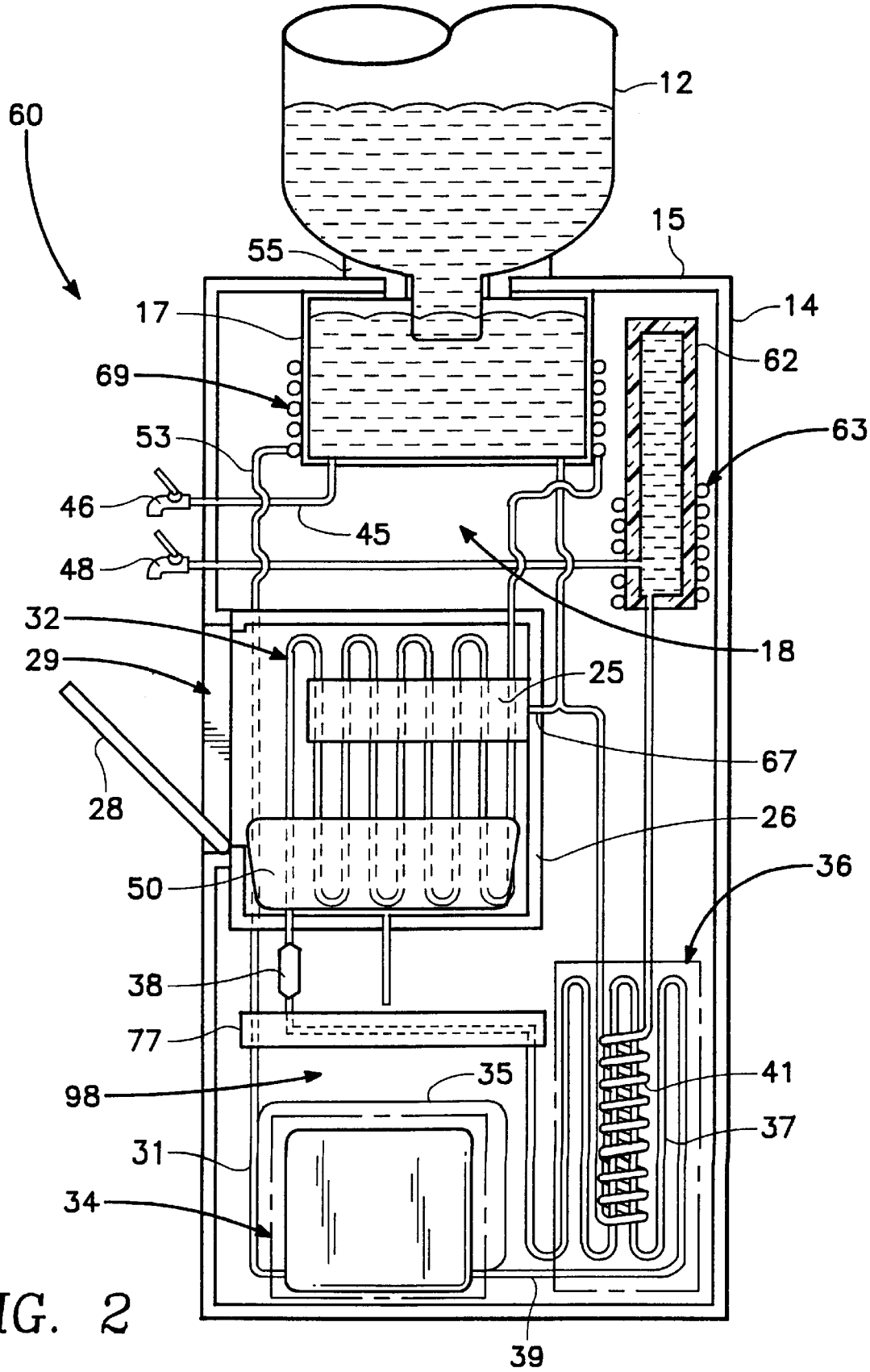
FIG. 2 is a schematic side elevational view similar to FIG. 1 showing a second embodiment of the water and ice dispensing apparatus of the invention.

With attention now to FIGS. 1 and 2, reference No. 10 refers to a first embodiment of the invention and reference No. 60 refers to a second embodiment of the invention. Both embodiments are shown using bottled water and gravity water flow.

Each of the embodiments includes an outer cabinet 14 which provides a superstructure for supporting the various modular subsystems. Inverted upon the top wall of the cabinet, is a water bottle 12. The bottle shoulder rests upon collar 55 that extends about the edges of a circular opening through top wall 15 of the cabinet.

The neck of the bottle extends into a water container shown as ambient reservoir 16 in FIG. 1 and cold reservoir 17 in FIG. 2. Water level in the reservoirs is maintained by gravity flow and atmospheric pressure in a manner known in the art.

The water and ice dispensing apparatus described herein operates by the integration of solenoid valves, thermostats, a temperature controller and associated components. Signals are received and transmitted by a control panel 11 through an integrator circuit 13. The system is operated by an electrical power source 30 which feeds current into the control panel. In addition to normal utility company power sources, portable generators, battery packs or solar panels may be used.

The cabinet interiors of both embodiments comprise a refrigeration region 18 and a compressor/condenser region 98 which are spaced-apart for improved thermal efficiency. The refrigeration region includes a compact refrigerating unit 20 which is located in the middle or upper portions of the cabinet. The unit takes-up about ¼ to ⅓ of the interior cabinet space and is defined by a housing 26 having a front opening 29 enclosed with a refrigerator door 28. The housing may also have a removable rear access panel (not shown) to facilitate cleaning and repair work.

The refrigerating unit may comprise a single freezer compartment 24 or it may be partitioned to provide a cool storage compartment 22. Within the freezer compartment may be an icemaking assembly 25. The assembly is mounted in the upper part of the compartment. As ice cubes are formed, they drop into an ice container 50 located at the bottom of the compartment.

Figure 5:
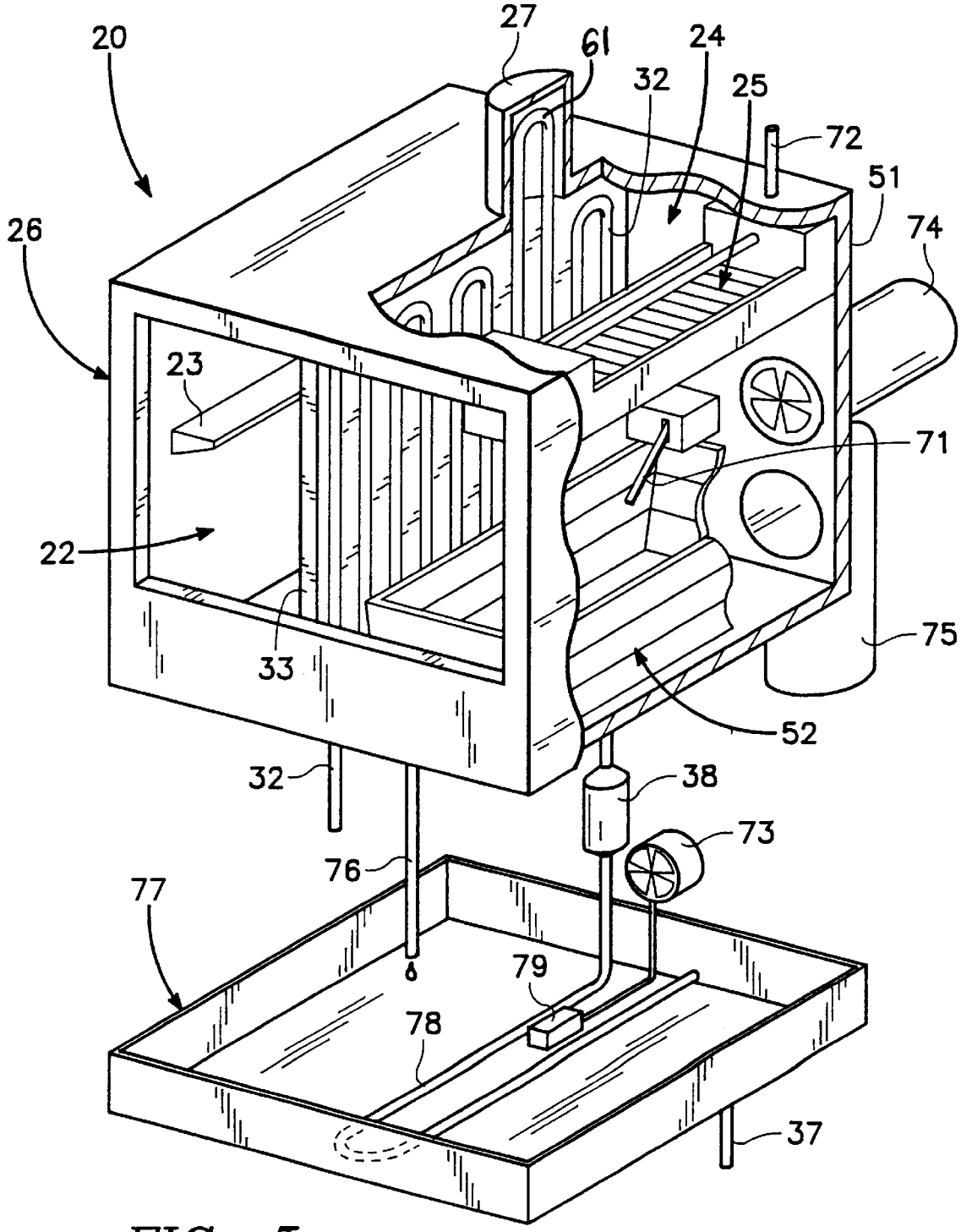
FIG. 5 is an enlarged isometric view of the refrigerator housing partially cut-away with a defrost water tray assembly spaced below the housing.
Figure 6:
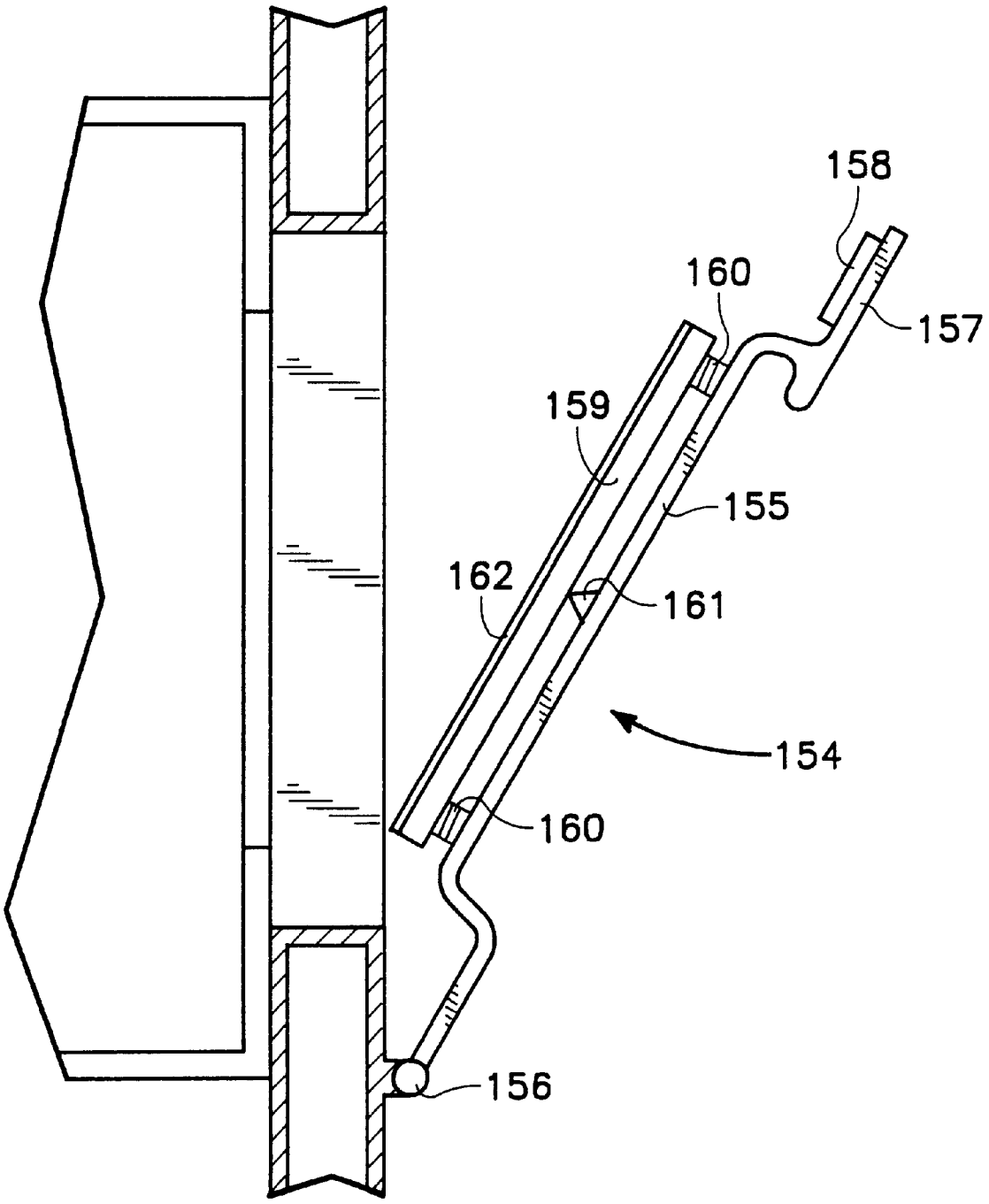
FIG. 6 is an enlarged side elevational view of an alternative refrigerator door hinged to the refrigerator housing.

As best illustrated in FIG. 5, the icemaking assembly 25 is supplied with water from freezer inlet line 72 which is connected to a water supply line. In the first embodiment, the water supply line is designated as line 43, in the second embodiment as line 67, in the third embodiment as line 93 and in the fourth embodiment as line 114.

The amount of ice production is controlled by mechanical bale 71. The bale is lifted by the accumulation of ice cubes. Upon reaching a predetermined level within container 50, the bale will deactivate the icemaking assembly. Simultaneously, a solenoid will close a valve in freezer inlet line 72. As ice is removed from the container, the bale will move downwardly to reactivate the switch and restart ice production.

The ice container may simply comprise a tray-like structure having sufficient volume to hold several dozen cubes. Alternatively, the container may be collapsible in the form of an open bag constructed of stiff fabric waterproof material such as canvas, nylon or woven plastic.

Figure 7:
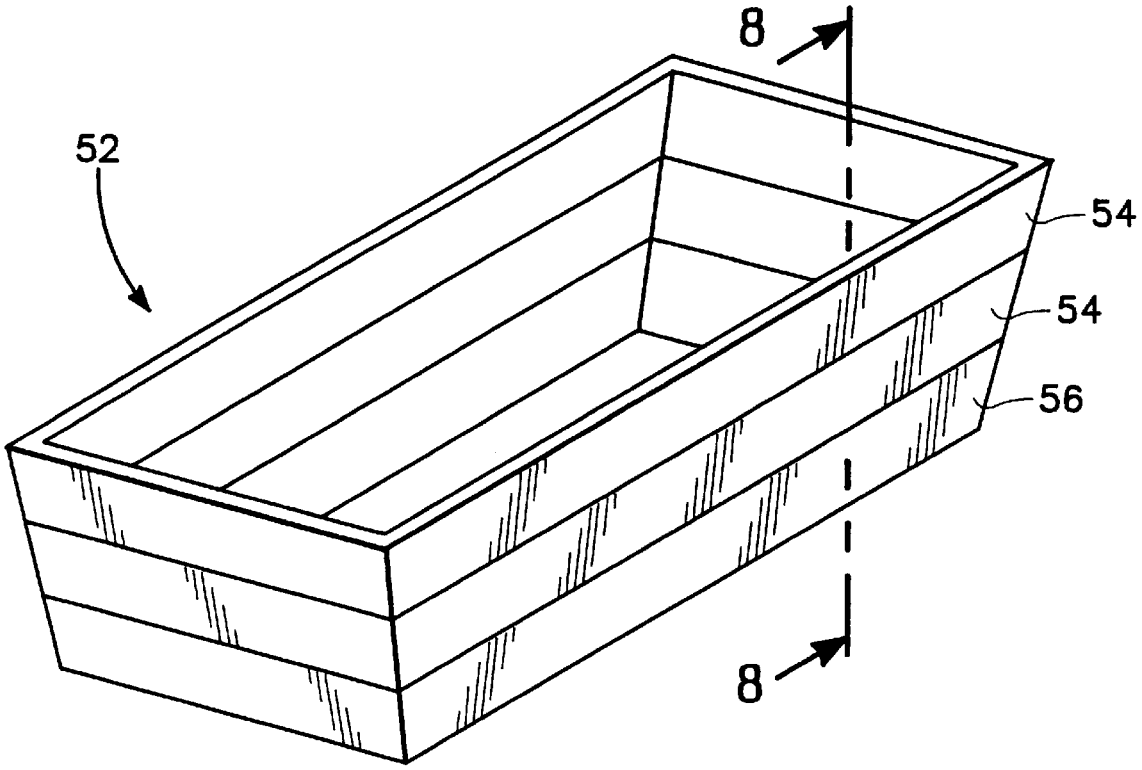
FIG. 7 is an isometric illustration of an alternative ice container having telescoping sidewalls.
Figure 8:
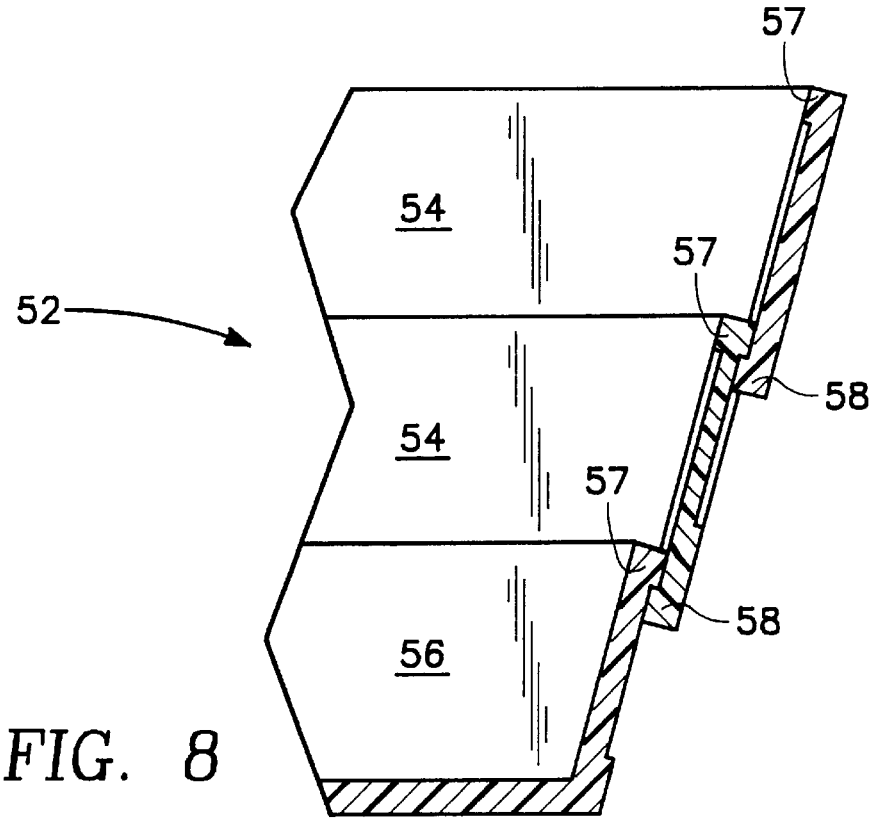
FIG. 8 is an enlarged cross-sectional view taken along lines 8—8 of FIG. 7.

Another ice container variation is the telescoping ice container 52 illustrated in FIGS. 7 and 8. In this variation, the container sidewalls are constructed of telescoping subframes 54 connected to a bottom tray 56. Corresponding upper and lower peripheral edges 57,58 of the tray and subframes become frictionally engaged when in a raised position. To remove the container from the freezer compartment, the subframes may be collapsed into each other and into tray 56.

With reference to FIGS. 1 and 5, the back wall of the refrigerator housing includes a housing fan 74. The fan is used to facilitate the production of ice in the freezer compartment 24. The fan moves air, depicted by arrow A, past refrigerator coils 32 and over the container of ice cubes. This movement inhibits the formation of frost crystals on the ice and interior sidewalls.

The cold air is exhausted through an outlet duct 75, as depicted by arrow B. The outlet duct is configured to direct the air over condenser tubes 37. The cold air augments cooling of the hot condenser tubes and the compressor/condenser region.

The housing fan 72 may be provided with an option air heating means to defrost the freezer compartment. A timing mechanism may be used in relation to the control panel to turn the fan on and off for predetermined periods of time.

Any spillage, melted ice or defrost water emanating from the freezer compartment will flow by gravity out drain tube 76 of the housing bottom into an underlying defrost tray 77. A short extended portion 78 of condenser coil 32, which is upstream from evaporator valve 38, is positioned in the bottom of the tray. The extended portion, being warm, will facilitate evaporation of the accumulated waste water. Likewise, the waste water will help cool the coolant as it passes through the extended portion.

Optionally, a moisture-detecting sensor 79 may be located within the defrost tray. The sensor will activate an auxiliary fan 73 whenever a predetermined amount of waste water is detected. The fan is positioned to create an air current over the water to enhance evaporation to further cool the condenser coil extension 78.

Figure 4:
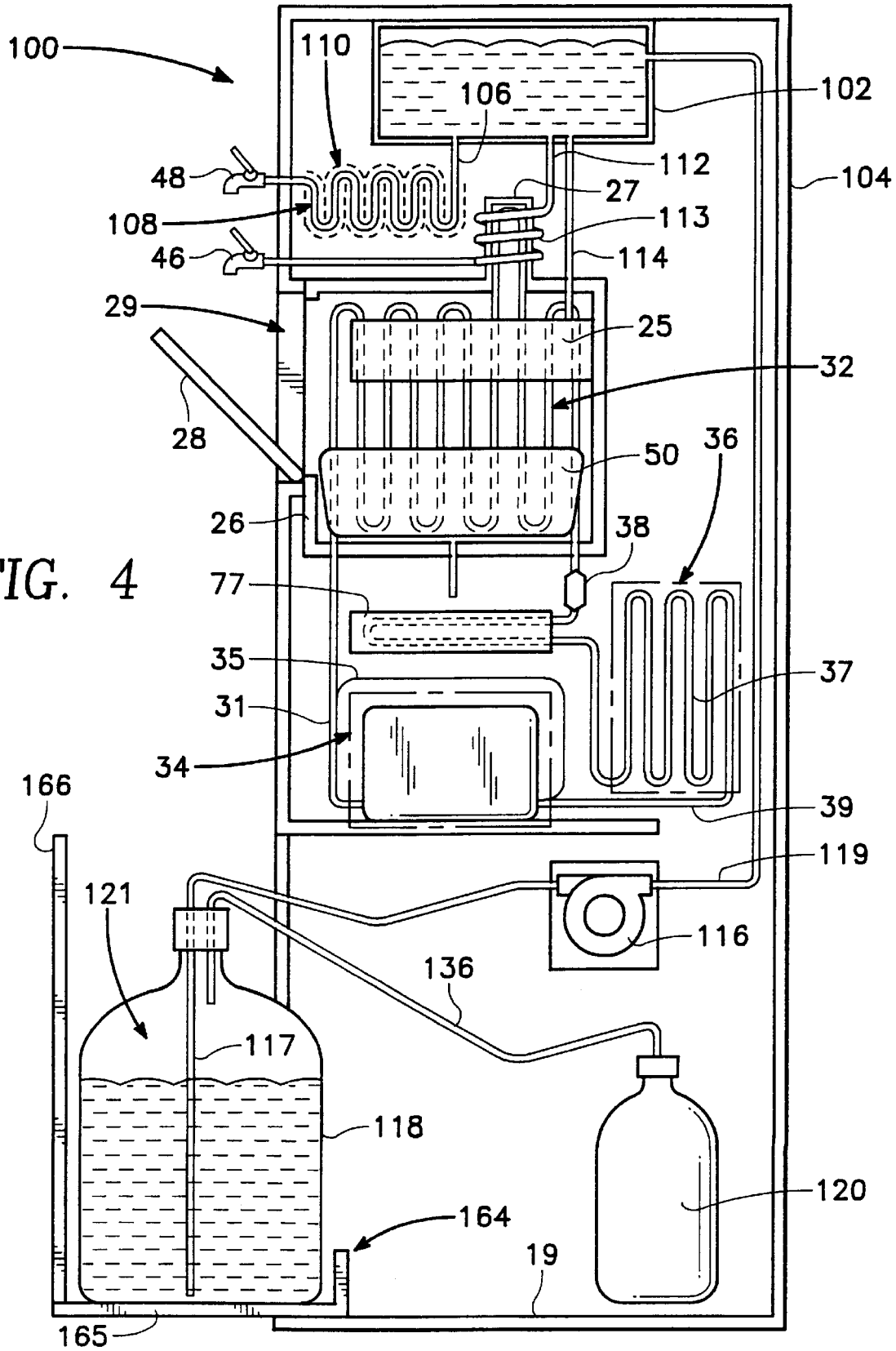
FIG. 4 is a schematic side elevational view of a fourth embodiment of the water and ice dispensing apparatus of the invention.

As mentioned above, the compressor unit 34 basically comprises a compressor 47 and a compressor drive motor 49. In prior art systems, a relatively powerful drive motor is necessary to overcome the initial high pressure differential between the compressor inlet and outlet during start-up. FIGS. 1, 2 and 4 illustrate a capillary tube 35 which is used to negate the above pressure differential. The capillary tube interconnects the compressor inlet line 31 with the compressor outlet line 39 thereby equalizing the initial inlet and outlet pressures.

The cool storage compartment 22 is best described in relation to FIG. 5. It is created by placement of a divider wall 33 within refrigerator housing 26. The wall extends from opening 29 to the housing back wall 51. The divider wall is sufficiently insulated from refrigerator coils 32 to permit a cool storage temperature which will not be below freezing.

Figure 13:
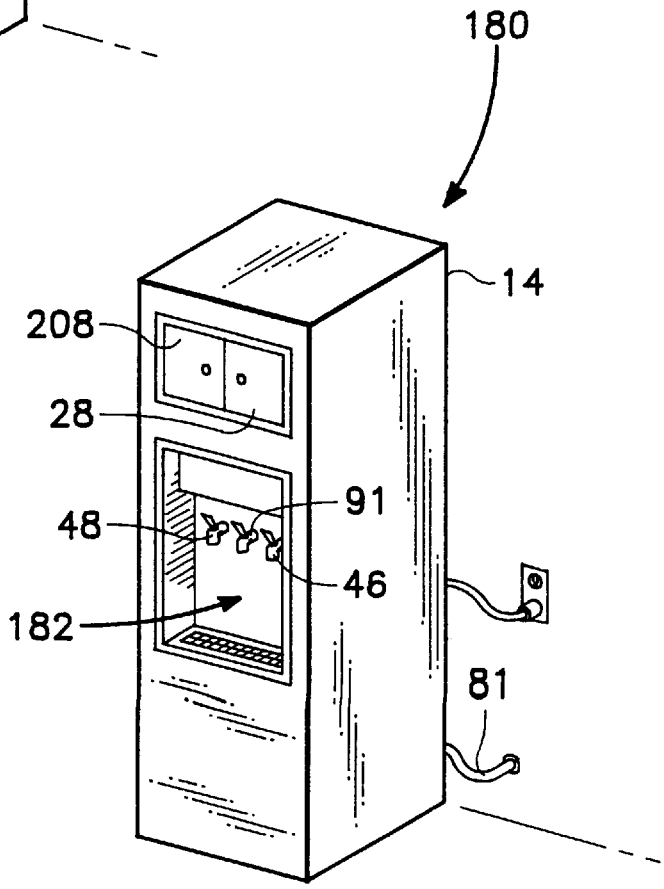
FIG. 13 is a reduced scale front isometric view of an alternative cabinet that may be used with the third embodiment of the invention.

The storage compartment may include one or more shelves as shown by wall shelf 23 in FIG. 5. The compartment may also be accessible by a separate door. As illustrated in FIG. 13, the storage compartment is enclosed by door 208 and the freezer compartment is enclosed with door 28. The doors may be laterally hinged to respective side edges of housing opening 29.

The refrigeration region is cooled by a closed loop refrigeration system. The system comprises a compressor unit 34 which pressurizes vaporized coolant from compressor inlet line 31 to a hot gas and liquid mixture exiting outlet 39. The mixture is passed through the cooling coils 37 of condenser unit 36. This unit may include a dryer and a cooling fan known in the art.

Thereafter, the cooled coolant passes through an expansion valve 38 where it is at least partially vaporized and becomes very cold, i.e., below freezing. The tubing lines downstream from the expansion value are referenced herein as refrigerator coils 32. As will be described hereinbelow, multiple segments of the refrigerator coil lines are used to cool corresponding sections of the refrigeration region.

As best shown in FIGS. 1, 2, 4 and 6, a first and coldest segment of the refrigerator coils are incorporated with selected walls of the refrigerator housing 26. Their placement and loop frequency are predetermined to achieve freezing temperatures in the freezer compartment and above freezing temperatures in the storage compartment.

In FIG. 2, the refrigerator coil line continues upwardly from the housing and merges into a second segment 69. The second segment is wrapped about the exterior of cold reservoir 17. It is expected that upon reaching the reservoir, the coolant will be above freezing and will not freeze the reservoir water.

It will be appreciated that by cooling a large body of water, such as that in the reservoir, an advantageous cool body heat sink is created for the overall refrigeration region 18. This functions to stabilize temperatures in the region and significantly simplifies temperature control. As a result, thermal efficiencies are high and costs are low.

As the coolant leaves the reservoir, it will be warmer and may be partially vaporized. The coolant will continue through connector line 53 which merges into compressor inlet line 34 to start the circulation cycle over.

Figure 3:
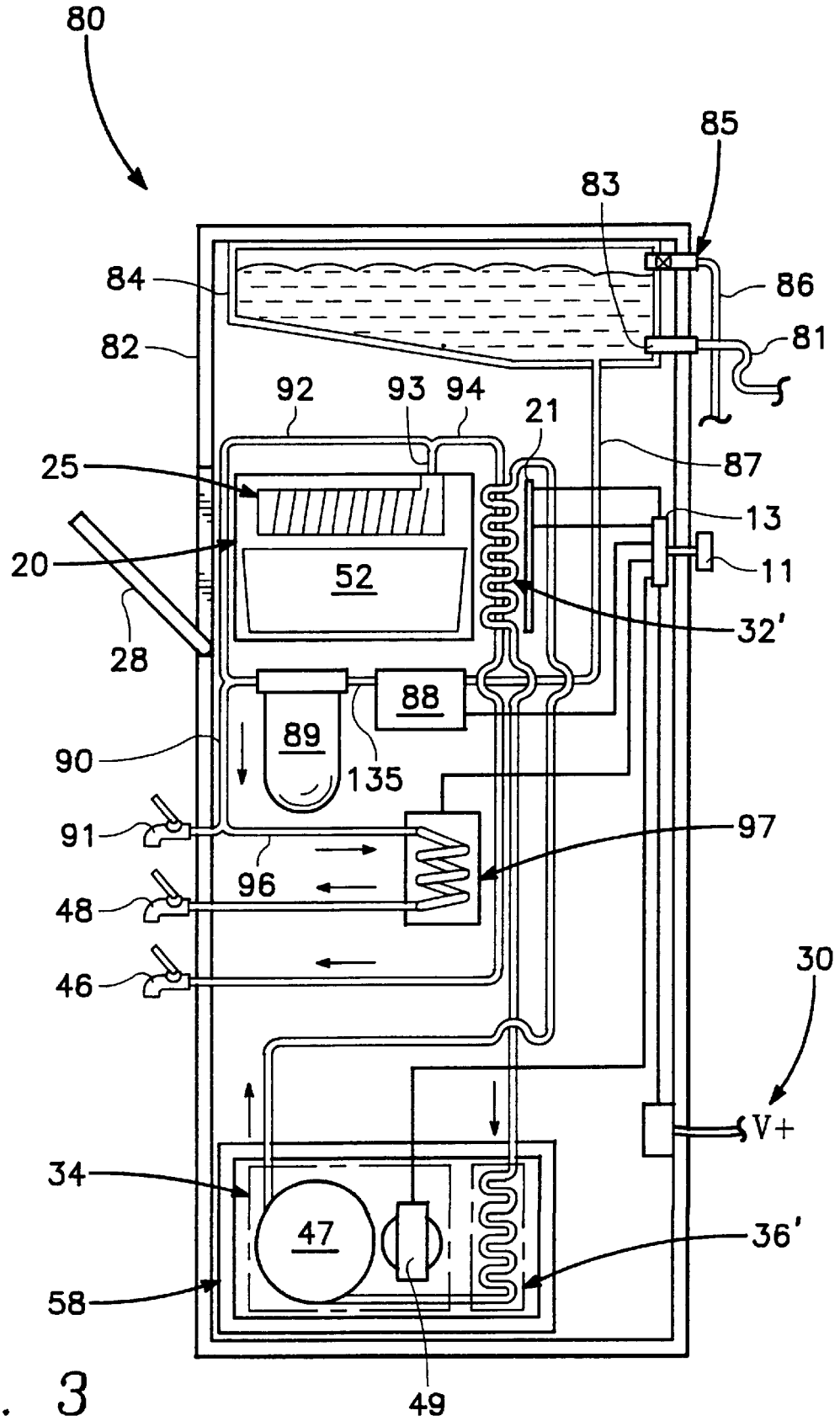
FIG. 3 is a schematic side elevational view of a third embodiment of the water and ice dispensing apparatus of the invention.

As depicted in FIG. 3, the compressor and condenser units are combined within a sub-housing 58. In this arrangement, the housing walls will be insulated. Also, the housing will be vented into corresponding vents in the lower wall portions of cabinet 14 (not shown).

As shown, the compressor unit 34 comprises an electric motor 49 which drives the compressor 47. Control panel 11 regulates operation of the motor and compressor in response to the desired freezer temperature detected by sensor 21. Together, the compressor and condenser units comprise the compressor/condenser region 98. The units generate significant heat energy when operating. Therefore, they are spaced-away from the refrigeration region and are preferably located near the base of the housing.

To further enhance efficiency, condenser tubes 37, shown in FIGS. 1 and 2, are spaced from the compressor and are at least partially wrapped with a coiled segment 41 of first water line 40. With reference to FIG. 1, the first water line delivers ambient water from reservoir 16 to coiled segment 41. As water passes through segment 41, it becomes preliminarily heated by conduction from the hot condenser tubes 37. This arrangement makes use of heat energy that would otherwise be wasted. Also, it lessens the amount of heat that can emanate toward the refrigerating unit.

With further reference to FIG. 1, after the water has been preheated at coiled segment 41, it flows to serpentine segment 42. Overlying the tubing of this segment is an electrical heating tape 44. The tape is thermostatically controlled to provide hot water to hot water spigot 48 at a predetermined temperature.

In FIG. 2, the preheated water from coiled segment 41 flows into hot water receptacle 62. The receptacle is provided with a heating means shown as external electrical heating coils 63. As with the heating tape shown in FIG. 1, the coils are thermostatically controlled to deliver hot water to hot water spigot 48 at a predetermined temperature. Alternative heating means known in the art could be used with the receptacle such as internal heater cores or immersible bayonet rods.

In the fourth embodiment 100 shown in FIG. 4, the first water line 106 flows by gravity directly into serpentine line 108. A hearing strip 110 overlies the serpentine line to conduct heat into the ambient water flowing to hot water spigot 48. As before, the amount of heat transfer is thermostatically controlled to provide a selected temperature in a manner known in the art.

In the third embodiment 80 shown in FIG. 3, water is piped-in from an outside source 81 such as a municipal water line. Therefore, cabinet 82 will have an inlet fitting 83 that interconnects the outside source with water chamber 84. The chamber is closed and water is moved through the system by the water source pressure.

To insure that the system operates at a desired pressure, the fitting 83 may include a pressure regulating valve. Also, the chamber is provided with a pressure relief valve 85 having a relief line 86 which may exhaust to an external drain (not shown) or defrost tray 77.

Because an outside source is being used, all water passing into the system from chamber 84 passes through a filtering system. In particular, chamber exit line 87 directs water from the chamber into *E-Coli* purification module 88 and then through particulate filter module 89.

Upon exiting the particulate filter unit, the water line divides into ambient line 90 and ice water line 92. The ambient line is connected directly to ambient water spigot 91. The ice line 92 divides into icemaker supply line 93 and cold water line 94. The icemaker supply line directs water into icemaker 25 where ice is produced in a manner described above.

The cold water line 94 passes through a fourth segment 32' of refrigerator coils 32 where it is cooled below room temperature and passes into cold water spigot 46. It will be appreciated that the exact temperature of the cold water emanating from the refrigerator coils will be primarily dictated by the operation of the refrigerating unit as detected and controlled by signal integrating unit 13 and control panel 11.

Figure 9:
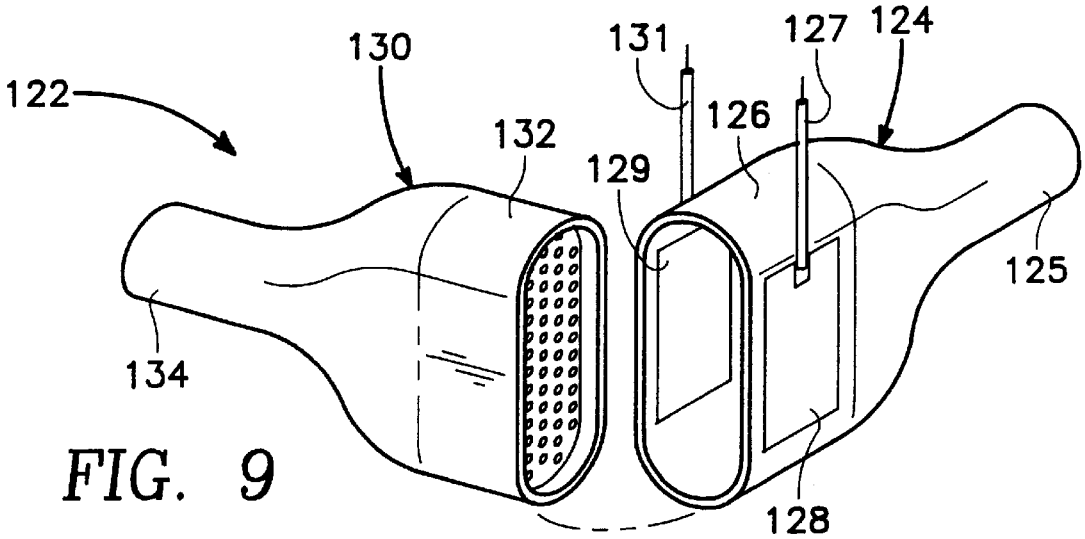
FIG. 9 is an isometric broken-away illustration of an in-line *E-coli* sanitization device.

FIG. 9 illustrates an in-line version of the *E-Coli* sanitization module 88 shown in FIG. 3. The in-line version, shown generally by reference 122, includes an inlet component 124 having a connector portion 125 for engagement with water chamber exit line 87.

The connector portion merges into an enlarged electron beam section 126 having a round, oval or rectangular cross section. One elongated wall of the electron beam section is provided with a respective anode plate 128. The opposing wall is provided with cathode plate 129. Application of a predetermined amount of electricity through anode wire 131 and cathode wire 127 will create an electron curtain between the plates. The electron curtain will kill *E-Coli* bacteria and contaminated water as the water passes through the electron curtain.

Because of the relative uniform cross-sectional spacing between the plates, water flow velocity will become relatively uniform across the aforementioned space. This will ensure complete destruction of the *E-Coli* bacteria.

Sealingly engaged with inlet component 124, is outlet component 130. As shown, this component is preferably a mirror image of the inlet component. Included with the outlet component is an enlarged exit section 132. To facilitate the aforementioned sealing engagement, this section has a cross-sectional configuration that corresponds to the electron beam section 126.

It is known that the element silver is also effective in killing *E-Coli* bacteria. As such, the exit section may include a silver screen structure depicted by reference 133. The screen structure will extend across the entire exit section interior. In this way, all contaminated water will contact the screen as it flows through the exit section. This action will effect complete destruction of the *E-Coli* bacteria.

Alternatively, the silver screen could be located in the electron beam section 126. In such case, it would preferably be positioned upstream from the aforementioned electron curtain.

Extending axially from exit section 132 is outlet portion 134. This portion communicates with module line 135 that connects with particulate filter module 89.

Figure 10:
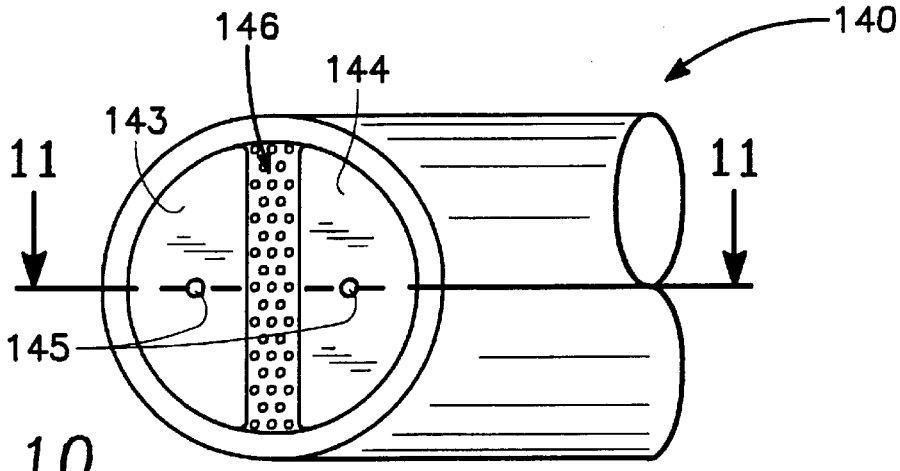
FIG. 10 is a bottom plan view of an alternative spigot equipped with an *E-coli* sanitization assembly.
Figure 11:
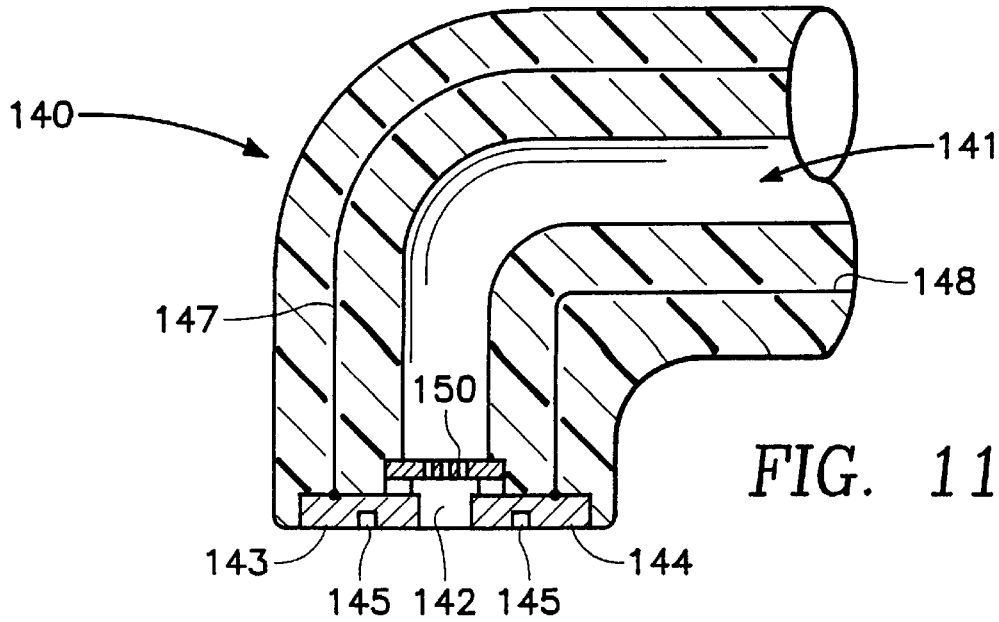
FIG. 11 is a cross-sectional view taken along lines 11—11 of FIG. 10.

In situations where only a single spigot is being used in relation to piped-in water, an *E-Coli* sanitization unit could be incorporated within the outlet of the spigot. In FIGS. 10 and 11, a version of an *E-Coli* spigot is shown by reference 140. The spigot includes inner bore 141 having a spigot outlet 142. The outlet is fitted with an anode disk 143 and a cathode disk 144. The periphery of each disk comprises a circular portion matching less than half of the outlet circumference and a straight edge portion about equal to the outlet diameter. The disks are preferably mirror images of each other and are retained within the outlet by spigot fasteners 145.

Because the circular periphery of each disk is less than half the outlet circumference, an slot-like outlet space 146 is created between their respective straight edges when installed within the spigot outlet. The space defines the opening for water flow out of the spigot.

Each disk is connected to a respective disk anode wire 147 and a disk cathode wire 148. Each wire is in electrical communication with a respective positive and negative source of electricity. The opposing charges across the narrow slot-like space 146 creates a strong curtain of electricity that destroys bacteria entrained in water flow therethrough. To further improve effectiveness, an optional silver screen mesh structure 150 may be secured within the cross-sectional area of the bore above outlet 142.

As with all the modules described herein, the *E-Coli* sanitization module may be a stand-alone unit. As such, it may be available as a replacement unit or it may be part of an overall filtering module.

After passing through the sanitization module, water flows through module line 135 into particulate filtering module 89. This module contains a mechanical filter element that is preferably disposable. A purpose of the filter is to constrain unwanted particulate matter so as to clarify the water and improve it's appearance. To replace and service the sanitization and particulate filter modules, it is expected that the rear of cabinet 14 will have a removable panel to permit access to the cabinet interior.

FIGS. 1, 4 and 5 illustrate a refrigerator housing having a heat exchange extension shown by reference 27. The extension comprises a round upright heat-conductive member projecting from the top wall of the refrigerator housing 26. To improve the heat exchange rate, an upraised part 61 of the refrigerator coils housing segment may extend into the interior of the extension member.

With reference to FIG. 1, a second water outlet line 65 extends from ambient reservoir 16 and merges into a coiled section 66. The coiled section comprises multiple encirclements of line 65 around extension member 27.

Upon opening cold water spigot 46, gravitational forces move the water from ambient reservoir 16 through the second outlet line 65 where the water becomes chilled by conductive contact with the extension. In a similar manner, FIG. 4 shows coiled section 113 of second outlet line 112 encompassing the refrigerator housing extension member. Ambient water passing through the coiled section will become cooled by conductive contact with extension member.

In the fourth embodiment, a pump means is used to move water through the system. As shown in FIG. 4, the pump means is a peristaltic pump 116 which is engaged with draw tube 117. The pump pulls water from water bottle 118 through the draw tube and forces it upwardly through pump line 119 to pump reservoir 102.

To assist or replace the peristaltic pump, the bottle may be pressurized to force water into the draw tube. To achieve this action, a pressurized air cylinder 120 may be used. The cylinder delivers air at a predetermined pressure into the water bottle air space 121 through air line 136. The air pressure will be sufficient to move water up draw tube 117 and into the pump or past the pump into pump reservoir 102.

Figure 14:
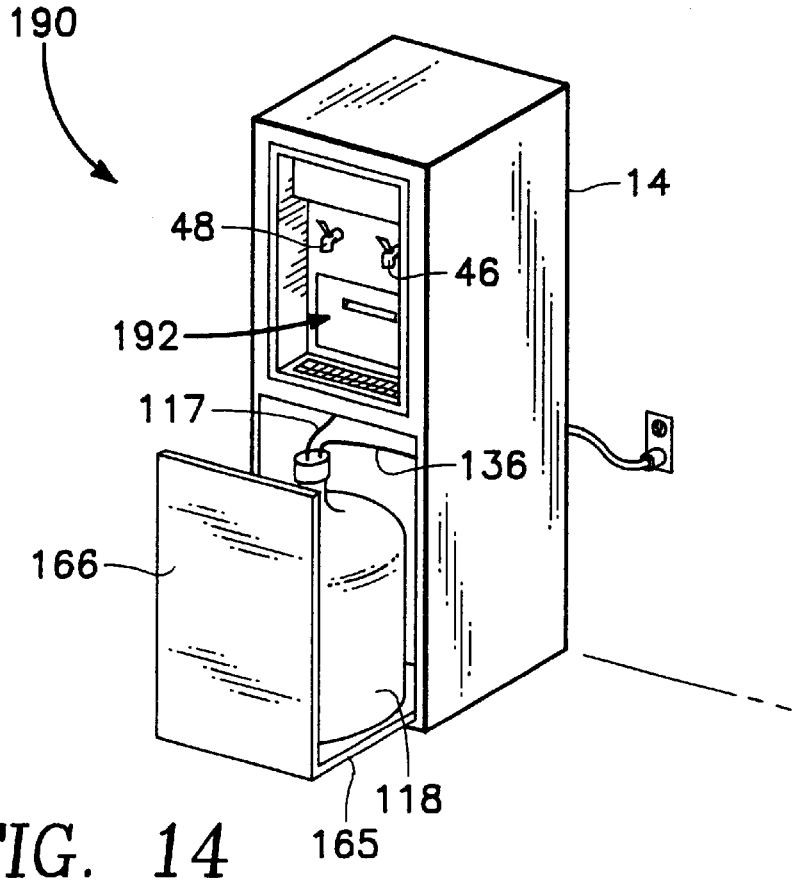
FIG. 14 is a reduced scale front isometric view of another alternative cabinet that may be used with the fourth embodiment of the invention.

To facilitate handling heavy water bottles, a movable bottle frame 164 may be used to support the bottle in the lower interior portion of cabinet 14. As shown in FIGS. 4 and 14, the bottle frame is L-shaped comprising an upstanding outer leg 166 and a lower leg 165. The lower leg supports bottle 118. The lower leg and the cabinet bottom wall 19 may include cooperating track means (not shown) for sliding the frame and bottle assembly in and out of the cabinet. The upstanding leg may comprise the front face of the cabinet lower chamber.

Figure 12:
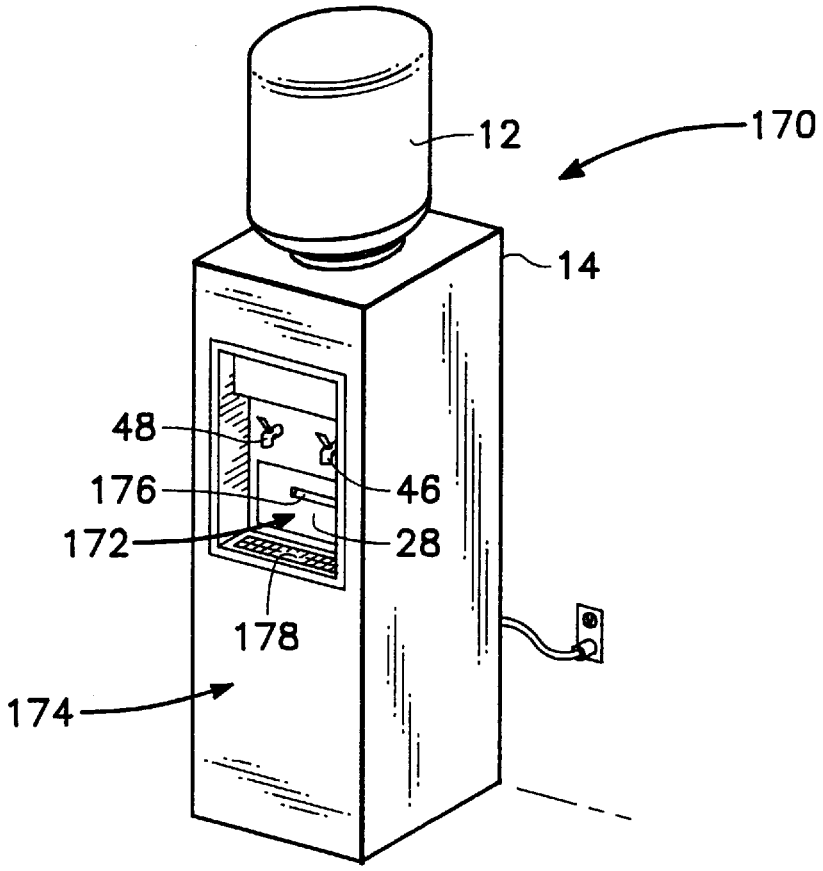
FIG. 12 is a reduced scale front isometric view of a cabinet that may be used with the first and second embodiments of the invention.

FIG. 12 illustrates an insulated and self-adjusting refrigerator door 154 as an alternative to door 28. The door body 155 is made of a plastic, laminate or metal material commonly used in the refrigeration art. It is connected to the cabinet by hinges 156 and includes a handle 157. A magnet 158 holds the door shut when placed against a corresponding metal plate on the cabinet.

An interior panel 159 is mounted to the door body by springs 160 and spacer 161. The panel provides additional insulation to the refrigeration compartment. A resilient gasket 162 is secured to the panel periphery. In use, the springs and gasket coact to provide a self-adjustment action for accommodating imperfections and misalignments in the door body or the door frame surface.

FIGS. 12–15, illustrate different cabinet formats adaptable for use in conjunction with the four interior embodiments described in relation to FIGS. 1–4. FIG. 12 illustrates a first cabinet format shown generally by reference 170. This format is adapted for use with the embodiments shown in FIGS. 1 and 2 wherein hot water and cold water spigots 46, 48 are provided within a recessed area 172 of the cabinet facade 174.

Below the spigots is refrigerator door 28 shown with an elongated horizontal notch to permit manual grasping. As mentioned previously, the door cover could be fixed to an interior ice container and function as a drawer. Alternatively, the door may be hinged to the refrigerator opening and rotate out as depicted in FIGS. 1–4. The self-adjusting door 154 could also comprise the refrigerator door shown in any of the cabinet formats.

At the bottom of the recessed area 172, is a drain area which is covered with a grid plate 178. The grid plate is adapted to provide support for containers being filled while also allowing spilled fluids to pass through to an external drain or to the previously described defrost tray.

A second cabinet format 180 is shown in FIG. 13. This format is suited for use in relation to the third embodiment described and shown in relation to FIG. 3. In this embodiment, bottled water is not used. Instead, an external source of water, shown by reference 81, is piped into the cabinet to fill an interior water chamber 84. In the upper portion of the cabinet are two doors. Door 208 provides access to the interior cool storage compartment. Door 28 allows access to the freezer compartment. The dual door arrangement could be used with any of the cabinet formats. The facade recess area 182 is provided with a hot water spigot 48, a room temperature spigot 91 and a cold water spigot 46.

The third cabinet format 190 is depicted in FIG. 14. This design is adapted to accommodate the fourth embodiment shown in FIG. 4. It is particularly suitable for users who have difficulty in lifting and inverting a water bottle upon the top of the cabinet. This problem has been overcome by providing a lower interior cabinet space in which the water bottle 118 may be contained. Since gravity flow is not possible, a water pump may be used. The pump will pull water from the bottle through draw tube 117 and move it into the interior system. Alternatively, pressurized air may be provided through line 136 to force water into draw tube 117 and up into the system.

The water bottle preferably sits in a cradle means which, as shown in FIG. 14, comprises a bottle frame having a lower leg 165 and an upstanding leg 166. The upstanding leg will comprise the lower portion of the cabinet facade. The upper portion of the cabinet is provided with a front recess area 192 containing cold water spigot 46, hot water spigot 48 and a drain assembly similar to that shown in relation to the first format 170.

Figure 15:
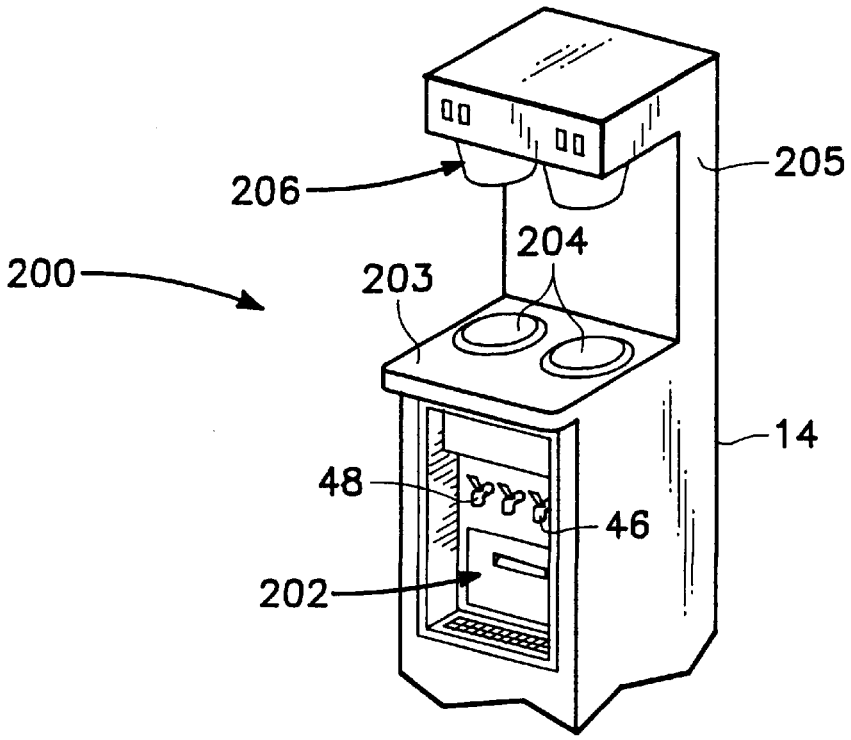
FIG. 15 is a fragmentary view of a cabinet similar to FIGS. 12 and 14 having an upper extension that includes hot plates and a coffee brewing assembly.

A fragmentary view of a fourth cabinet format 200 is shown in FIG. 15. In this version, a recessed area 202 is provided in the middle portion of the cabinet. The recess includes three spigots and a refrigerator door. Above the recess area is a mid-shelf 203 which includes hot plates 204. The cabinet includes an L-shaped upper extension 205 within which is provided a coffee brewing assembly 206. It is expected that the hot plates and brewing assembly will function in a manner known in the art to provide extra convenience for users of the apparatus.

While the invention has been described with respect to preferred embodiments, it will be clear to those skilled in the art that modifications and improvements may be made to the invention without departing from the spirit and scope of the invention. Therefore, the invention is not to be limited by the specific illustrative embodiments, but only by the scope of the appended claims.

We claim:

1. A water and ice dispensing apparatus comprising:

a cabinet having a hot water spigot and a cold water spigot said cabinet defining an interior comprising a compressor/condenser region and a refrigeration region, said regions being spaced-apart from each other;

said refrigeration region containing a freezer compartment and a water reservoir;

refrigerator coils extending from said compressor/condenser region having a first section positioned in cooling relation to said freezer compartment and a second section positioned in cooling relation to said water reservoir;

a cold water line extending from said water reservoir to said cold water spigot;

a hot water line extending from said water reservoir to said hot water spigot; and, at least one heat exchange means located within said cabinet for transferring heat to water from said water reservoir that flows through said hot water line.

2. The apparatus of claim 1, wherein said heat exchange means comprises a hot water receptacle thermally isolated from said refrigeration region which is in communication with said hot water line.

3. The apparatus of claim 1 including an electrical power source, said heat exchange means comprising an electrical heating strip in communication with said power source, said strip being positioned in heat-conductive relation to said hot water line.

4. The apparatus of claim 1 wherein said compressor/condenser region includes condenser coils, said hot water line having a portion that is located in heat conducting relation to said condenser coils.

5. The apparatus of claim 1 including an electrical power source, said freezer compartment including a fan means in communication with said power source for moving air through said compartment, said compartment including an outlet duct for directing the moving air into said compressor/condenser region.

6. The apparatus of claim 1 wherein said refrigeration region includes a defrost water tray positioned beneath said freezer compartment, said freezer compartment including a drain for permitting gravity flow of defrost water into said tray.

7. The apparatus of claim 6 wherein said compressor/condenser region includes condenser coils having an extended portion which is located within said tray.

8. The apparatus of claim 6 including an electrical power source, said tray having an auxiliary fan means in electrical communication with said power source to direct air into said tray.

9. The apparatus of claim 8 wherein said tray is provided with a moisture sensor which activates said auxiliary fan means.

10. The apparatus of claim 1 wherein said freezer compartment includes an icemaker system and a container for receiving ice produced by said icemaker system.

11. The apparatus of claim 10 wherein said container is collapsible.

12. The apparatus of claim 1 wherein said refrigeration region includes a storage compartment adjacent said freezer compartment.

13. The apparatus of claim 1 including a freezer compartment temperature sensor for controlling the temperature of said refrigerator region.

* * * * *